US009034438B2

(12) United States Patent
Fuchita et al.

(10) Patent No.: US 9,034,438 B2
(45) **Date of Patent: *May 19, 2015**

(54) DEPOSITION METHOD USING AN AEROSOL GAS DEPOSITION FOR DEPOSITING PARTICLES ON A SUBSTRATE

(71) Applicants: Fuchita Nanotechnology Ltd., Chiba (JP); National University Corporation Nagoya University, Aichi (JP)

(72) Inventors: Eiji Fuchita, Chiba (JP); Yasutoshi Iriyama, Aichi (JP)

(73) Assignees: Fuchita Nanotechnology LTD., Chiba (JP); National University Corporation Nagoya University, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/930,328

(22) Filed: Jun. 28, 2013

(65) Prior Publication Data

US 2014/0004260 A1 Jan. 2, 2014

(30) Foreign Application Priority Data

Jun. 28, 2012 (JP) ..... 2012-145311

(51) Int. Cl.
*B05D 1/12* (2006.01)
*C23C 24/02* (2006.01)

(52) U.S. Cl.
CPC .. *B05D 1/12* (2013.01); *C23C 24/02* (2013.01)

(58) Field of Classification Search
USPC ..... 427/469–470
See application file for complete search history.

(56) References Cited

U.S. PATENT DOCUMENTS

2008/0166476 A1* 7/2008 Akedo et al. ..... 427/128
2010/0129536 A1* 5/2010 Yamada et al. ..... 427/126.3

FOREIGN PATENT DOCUMENTS

GB 1069423 * 5/1967
JP 2005-036255 A 2/2005
JP 2005-290462 A 10/2005

* cited by examiner

*Primary Examiner* — Frederick Parker
(74) *Attorney, Agent, or Firm* — Saliwanchik, Lloyd & Eisenschenk

(57) ABSTRACT

A deposition method includes placing fine particles in an airtight container, the fine particles being obtained by forming a coating layer on a surface of a matrix, the coating layer being more liable to be charged than the matrix with respect to a material of a conveying path, generating an aerosol of the fine particles by introducing a career gas into the airtight container, transporting the aerosol via a transfer tubing to a deposition chamber which is maintained at a pressure lower than that in the airtight container while charging the fine particles by friction with the inner surface of the transfer tubing, the transfer tubing being connected to the airtight container and having a nozzle at the tip, and depositing the charged fine particles on a substrate placed in the deposition chamber by spraying the aerosol from the nozzle.

5 Claims, 2 Drawing Sheets

DEPOSITION METHOD USING AN AEROSOL GAS DEPOSITION FOR DEPOSITING PARTICLES ON A SUBSTRATE

CROSS-REFERENCE TO RELATED APPLICATION

This application claims the benefit under 35 U.S.C. §119 of Japanese Patent Application No. 2012-145311, filed Jun. 28, 2012, which is hereby incorporated by reference in its entirety.

BACKGROUND

The present disclosure relates to a deposition method using an aerosol gas deposition technique.

An aerosol gas deposition technique is a deposition method of converting fine particles or powders placed in an aerosol-generating container as a source material into an aerosol by agitation with a career gas, transporting the aerosol as the gas stream under the pressure difference between the aerosol-generating container and the deposition chamber and thus, making it collide with a substrate to synthesize a thin film on it.

It is considered that the optimal mean diameter of fine particles applicable for the aerosol gas deposition technique is generally about 0.5 μm. The film formation by such deposition method is performed by using the powder whose particle size is close to such size condition. On the other hand, in the case where the particle diameter of the fine particles is larger than this, it is considered that the density or adhesiveness of the film is further increased. However, it has been difficult to form a film steadily.

On the other hand, Japanese Patent Application Laid-open No. 2005-036255 discloses a method of converting fine particles whose surface is activated by plasma irradiation or microwave irradiation into an aerosol and spraying the fine particles on a substrate. As described above, by applying some kind of energy to fine particles, it is possible to get rid of the existence of an inert surface caused by adsorption of any impurity on the surfaces of the fine particles or the like. Accordingly, it is possible to facilitate the formation of a construction.

Moreover, Japanese Patent Application Laid-open No. 2005-290462 discloses an aerosol deposition apparatus including a means for ionizing an aerosol and a means for applying bias voltage opposite in polarity to that of the ion of the aerosol to a substrate. As the means for ionizing an aerosol, a high-voltage apparatus forming a non-uniform electric field, or a magnetron is exemplified. With the above-mentioned configuration, an aerosol having a predetermined concentration collides with a substrate. As a result, it is possible to deposit more fine particles on the substrate.

BRIEF SUMMARY

In the configurations disclosed in Japanese Patent Application Laid-open No. 2005-036255 and Japanese Patent Application Laid-open No. 2005-290462, however, the gas deposition apparatus needs to be equipped with a plasma generating mechanism or high-voltage generating device, which causes a problem that the apparatus will have a large and complicated configuration. Further, the control of the apparatus becomes complicated, and many parameters are needed to be controlled. It is expected to be difficult to form an aimed film constantly under the optimal conditions.

In view of the circumstances as described above, it is desirable to provide a deposition method that enables fine particles having a relatively large particle diameter to be deposited stably on a substrate by using a simple configuration.

According to an embodiment of the present disclosure, there is provided a deposition method including placing fine particles in an airtight container, the fine particles being obtained by forming a coating layer on a surface of a matrix, the coating layer being more liable to be charged than the matrix with respect to a material of a conveying path.

An aerosol of the fine particles is generated by introducing a career gas into the airtight container.

The aerosol is conveyed via a transfer tubing to a deposition chamber which is maintained at a pressure lower than that in the airtight container while charging the fine particles by friction with the inner surface of the transfer tubing, the transfer tubing being connected to the airtight container and having a nozzle at the tip.

The charged fine particles are deposited on a substrate placed in the deposition chamber by spraying the aerosol from the nozzle.

These and other objects, features and advantages of the present disclosure will become more apparent in light of the following detailed description of best mode embodiments thereof, as illustrated in the accompanying drawings.

DETAILED DESCRIPTION

Figure 1:
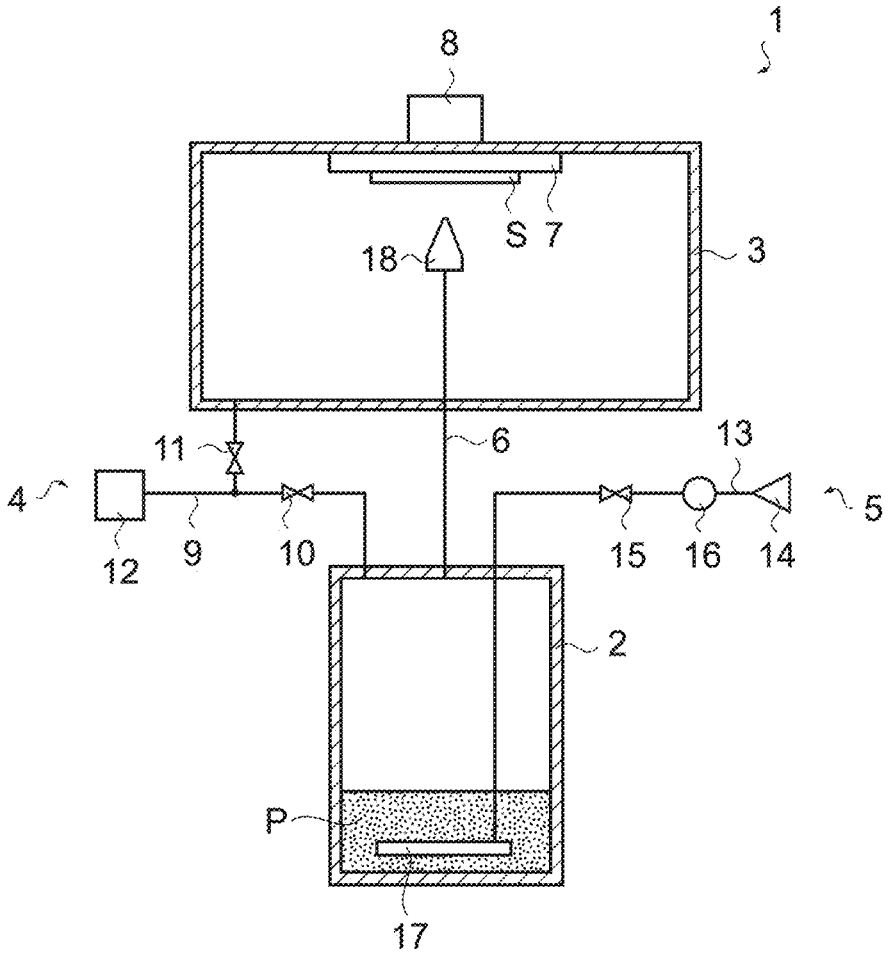
FIG. 1 is a schematic diagram showing the configuration of an aerosol gas deposition apparatus used for an embodiment of the present disclosure.

A deposition method according to an embodiment of the present disclosure includes placing fine particles in an airtight container, the fine particles being obtained by forming a coating layer on a surface of a matrix, the coating layer being more liable to be charged than the matrix with respect to a material of a conveying path.

An aerosol of the fine particles is generated by introducing a career gas into the airtight container.

The aerosol is conveyed via a transfer tubing to a deposition chamber which is maintained at a pressure lower than that in the airtight container while charging the fine particles by friction with the inner surface of the transfer tubing, the transfer tubing being connected to the airtight container and having a nozzle at the tip.

The charged fine particles are deposited on a substrate placed in the deposition chamber by spraying the aerosol from the nozzle.

In the deposition method, by making the fine particles collide with the conveying path (the inner surface of the nozzle and the inner surface of the transfer tubing), static electricity is generated on the surfaces of the fine particles and the charged fine particles are deposited on the substrate during conveyance of the aerosol by a transfer tubing. As the electric charge amount of the fine particles becomes large, the density of the film is increased and the deposition rate is improved.

The excess charges of the deposited fine particles are released into space in the deposition chamber, which causes significant light emission depending on the amount of the released charges. This light emission phenomenon is derived mainly from plasma. An electron is supplied from the side of the deposition chamber to the fine particles via plasma, which is a good conductor of electricity, thereby strengthening a bond between the fine particles. Thus, the adhesiveness is improved. Accordingly, it is possible to form a film easily even with fine particles having a relatively large particle diameter comparing to former documents.

On a surface of a matrix of the fine particles used in the deposition method, a coating layer, which is more liable to be charged than the matrix with respect to a material of a conveying path, is formed. Accordingly, it is possible to form a film stably even with fine particles including a matrix that is relatively unlikely to be charged.

In the case where the matrix of the fine particles includes a metal oxide such as $LiCoO_2$, $SrTiO_3$, and ZnO, the coating layer includes Nb, Ba, Sc, Ca, or the like. Accordingly, it is possible to form a thin film including a metal oxide such as $LiCoO_2$, $SrTiO_3$, and ZnO.

According to an embodiment of the present disclosure, the nozzle includes a metal material. In this case, the coating layer of the fine particles includes a metal material having a work function smaller than that of the metal material included in the nozzle. Accordingly, the fine particles are positively charged. As described above, because the nozzle and the coating layer include metal materials having different work functions, it is possible to cause the fine particles to be charged stably.

The thickness of the coating layer of the fine particles is not particularly limited. The coating layer is not limited to the case where the entire surface of the matrix is coated, and it only has to coat at least a part of the surface of the matrix. By forming the coating layer so as to have a thickness of 10 nm or more, charging effects of the fine particles are obtained. Moreover, by forming the coating layer so as to have a thickness of 30 nm or more, for example, it is possible to ensure stable deposition while intending to improve the deposition rate.

Hereinafter, embodiments of the present disclosure will be described with reference to the drawings.

FIG. 1 is a diagram showing the schematic configuration of an aerosol gas deposition apparatus 1 (hereinafter, referred to as AGD apparatus 1) according to an embodiment of the present disclosure.

As shown in FIG. 1, the AGD apparatus 1 has an aerosol-generating container 2 (airtight container), a deposition chamber 3, an exhaust system 4, a gas-supplying system 5, and a transfer tubing 6. The aerosol-generating container 2 and the deposition chamber 3 form respective independent chambers, and internal spaces of the chambers are connected to each other by the transfer tubing 6. The exhaust system 4 is connected to the aerosol-generating container 2 and the deposition chamber 3. The gas-supplying system 5 is connected to the aerosol-generating container 2. Moreover, an aerosol raw material P is placed in the aerosol-generating container 2. A substrate S is placed in the deposition chamber 3.

The aerosol-generating container 2 stores the aerosol raw material P and generates an aerosol therein. The aerosol-generating container 2 is connected to a ground potential and has a hermetically sealable structure with a lid portion (not shown) for introduction and removal of the aerosol raw material P. The aerosol-generating container 2 is connected to the exhaust system 4 and the gas-supplying system 5. The AGD apparatus 1 may additionally have a vibration mechanism of vibrating the aerosol-generating container 2 for agitation of the aerosol raw material P or heating means for heating the container for degassing (removal of water and the like) of the aerosol raw material P.

The deposition chamber 3 stores the substrate S. The deposition chamber 3 is configured to be capable of keeping its internal pressure constant. The deposition chamber 3 is connected to the exhaust system 4. Moreover, the deposition chamber 3 has a stage 7 for holding the substrate S and a stage-driving mechanism 8 for moving the stage 7. The stage 7 may have heating means for heating the substrate S for degassing the substrate S before deposition. In addition, the deposition chamber 3 may have a vacuum gauge indicating the internal pressure. The deposition chamber 3 and the stage 7 are connected to a ground potential.

The exhaust system 4 vacuum-evacuates the aerosol-generating container 2 and the deposition chamber 3. The exhaust system 4 has a vacuum tubing 9, a first valve 10, a second valve 11, and a vacuum pump 12. The vacuum tubing 9 connected to the vacuum pump 12 is branched and connected to the aerosol-generating container 2 and the deposition chamber 3.

The first valve 10 is installed on the vacuum tubing 9 between the branch point of the vacuum tubing 9 and the aerosol-generating container 2, and is configured to be capable of blocking vacuum evacuation of the aerosol-generating container 2. The second valve 11 is installed on the vacuum tubing 9 between the branch point of the vacuum tubing 9 and the deposition chamber 3, and is configured to be capable of blocking vacuum evacuation of the deposition chamber 3. The configuration of the vacuum pump 12 is not particularly limited, and the vacuum pump 12 may include a plurality of pump units. The vacuum pump 12 may be, for example, a mechanical booster pump and a rotary pump that are connected in series.

The gas-supplying system 5 supplies a carrier gas for specifying the pressure in the aerosol-generating container 2 and generating an aerosol to the aerosol-generating container 2. Examples of the carrier gas include $N_2$, Ar, He, $O_2$, and dry air.

The gas-supplying system 5 includes a gas tubing 13, a gas source 14, a third valve 15, a gas flowmeter 16, and a gas-blowout unit 17. The gas source 14 and the gas-blowout unit 17 are connected to each other through the gas tubing 13, and the third valve 15 and the gas flowmeter 16 are installed on the gas tubing 13. The gas source 14 is, for example, a gas cylinder, and supplies the carrier gas. The gas-blowout unit 17, which is installed in the aerosol-generating container 2, uniformly blows out the carrier gas supplied through the gas tubing 13. The gas-blowout unit 17 may be, for example, a hollow unit having many gas-blowout holes, and may convert the aerosol raw material P into an aerosol by effective agitation, as it is located at the position embedded in the aerosol raw material P. The gas flowmeter 16 indicates the flow rate of the carrier gas flowing in the gas tubing 13. The third valve 15 is configured to be capable of regulating the flow rate of the carrier gas flowing in the gas tubing 13 or blocking the carrier gas.

The transfer tubing 6 conveys the aerosol formed in the aerosol-generating container 2 into the deposition chamber 3. The transfer tubing 6 is connected to the aerosol-generating container 2 at one end. The transfer tubing 6 includes a nozzle 18 provided at the other end thereof.

The nozzle 18 has a round hole or slit-shaped opening, which has a small diameter. The blowout rate of the aerosol can be specified by, for example, the diameter of the opening of nozzle 18. The nozzle 18 is installed at a position facing the substrate S. Moreover, the nozzle 18 is connected to a nozzle moving mechanism (not shown) specifying the position and the angle of the nozzle 18 for specification of the distance and angle of the ejected aerosol to the substrate S. The transfer tubing 6 and the nozzle 18 are connected to a ground potential.

The nozzle 18 includes a metal material such as stainless steel. The inner surface of the passage in the nozzle 18 through which the aerosol passes may be coated with a carbide material. Accordingly, it is possible to reduce attrition due to the collision with the fine particles forming the aerosol, and to increase the durability. Examples of the carbide material include titanium nitride (TiN), titanium carbide (TiC), tungsten carbide (WC), and diamond-like carbon (DLC).

The inner surface of the transfer tubing 6 is formed of a conductor. Typically, as the transfer tubing 6, a linear metal tubing such as a stainless tubing is used. The length and inner diameter of the transfer tubing 6 can be appropriately set. For example, the length of the transfer tubing 6 is 300 mm to 1000 mm, and the inner diameter of the transfer tubing 6 is 4.5 mm to 24 mm.

The shape of the opening of the nozzle 18 may be circular or slot-like. In this embodiment, the shape of the opening of the nozzle 18 is slot-like, and the length of the opening is 10 times or more and 1000 times or less its width. If the ratio between length and width of the opening is less than 10 times, it is difficult to effectively cause the fine particles to be charged in the nozzle. Moreover, if the ratio between length and width of the opening exceeds 1000 times, the charging efficiency of the fine particles can be increased. However, the spraying amount of the fine particles is restricted, and the deposition rate is significantly decreased. The ratio between length and width of the opening of the nozzle is favorably 20 times or more and 800 times or less, more favorably, 30 times or more and 400 times or less.

The substrate S includes, for example, glass, metal, ceramic, and a silicon substrate. As described above, the AGD method is a deposition method that can be performed at normal temperature and also a physical deposition method without any chemical processing, and thus, allows a wide variety of selection of materials as the substrate. In addition, the substrate S is not limited to one having a flat shape and may be three-dimensional.

The AGD apparatus 1 is configured in such a manner. It should be noted that the configuration of the AGD apparatus 1 is not limited to that described above. For example, a gas-supplying mechanism different from the gas-supplying system 5, which is connected to the aerosol-generating container 2, may be additionally installed. In the configuration described above, the pressure in the aerosol-generating container 2 is adjusted and an aerosol is formed by agitation of the aerosol raw material P, by the carrier gas supplied by the gas-supplying system 5. It should be noted that it is possible, by separately supplying the gas for pressure adjustment from the different gas-supplying means, to regulate the pressure in the aerosol-generating container 2, independently of the generation state of aerosol (generation amount, diameter of the particles mainly agitated, etc.).

The aerosol raw material P is converted into an aerosol in the aerosol-generating container 2 and is deposited on the substrate S. The aerosol raw material P includes fine particles including a material to be deposited. As the aerosol raw material P, fine particles having characteristics to be charged by the collision with the inner surface of the transfer tubing 6 and the inner surface of the nozzle 18, which constitute the conveying path of the aerosol, are used.

In this embodiment, as such fine particles, fine particles having a coating layer formed on a surface of a matrix thereof, which is more liable to be charged than the matrix with respect to a material of a conveying path, are used. The matrix includes a metal oxide such as $LiCoO_2$, $SrTiO_3$, $LiNiO_2$, and ZnO. The coating layer includes metal such as Nb, Ba, Sc, and Ca, or a metal oxide such as NbOx, BaOx, CaOx, and ScOx, which is selected depending on the kind of the matrix.

The polarity of static electricity applied to the fine particles is determined by the triboelectric series or magnitude of the work function. In this embodiment, the coating layer includes a metal material having a work function smaller than that of a metal material included in the nozzle. Therefore, the fine particles (aerosol raw material P) are positively charged. As described above, because the nozzle and the coating layer include metal materials having different work functions, it is possible to cause the fine particles to be charged stably.

The thickness of the coating layer of the fine particles is not particularly limited. The coating layer is not limited to the case where it is formed so as to have a thickness that can coat the entire surface of the matrix. By forming the coating layer so as to have a thickness of 10 nm or more, charging effects of the fine particles are obtained. Moreover, by forming the coating layer so as to have a thickness of 30 nm or more, it is possible to ensure stable deposition while intending to improve the deposition rate.

The particle diameter of the aerosol raw material P is not particularly limited. However, for example, fine particles having a mean particle diameter ($D_{50}$) of 0.5 μm or more and 10 μm or less can be applied.

Figure 2:
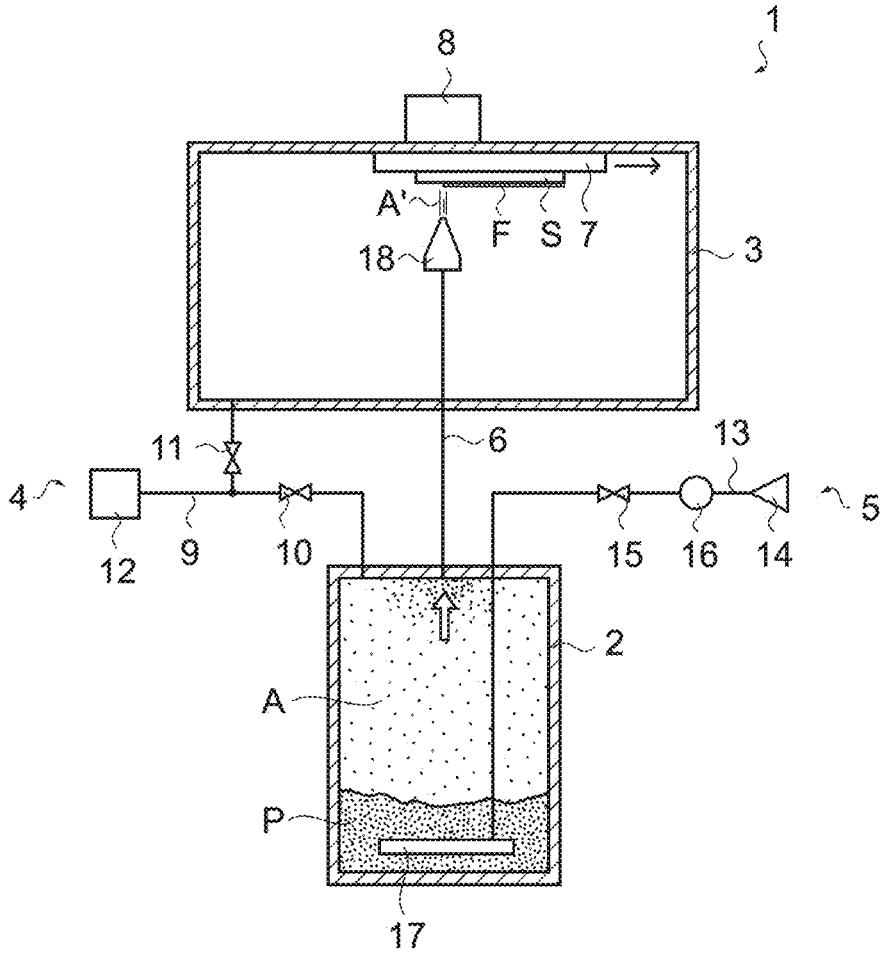
FIG. 2 is a schematic diagram for explaining an operation of the aerosol gas deposition apparatus.

Next, a deposition method according to this embodiment will be described with reference to FIG. 2. FIG. 2 is a schematic diagram for explaining an operation of the AGD apparatus 1. Hereinafter, a method of depositing lithium cobalt oxide ($LiCoO_2$) using the AGD apparatus 1 will be described.

A predetermined amount of the aerosol raw material P ($LiCoO_2$ powder) is placed in the aerosol-generating container 2. It should be noted that the aerosol raw material P may be previously degassed under heat. Alternatively, the aerosol-generating container 2 may be heated with the aerosol raw material P placed inside, for degassing the aerosol raw material P. It is possible, by degassing the aerosol raw material P, to prevent aggregation of the $LiCoO_2$ fine particles by water or contamination of the thin film with impurities.

Next, the aerosol-generating container 2 and the deposition chamber 3 are vacuum-evacuated by the exhaust system 4.

The first valve 10 and the second valve 11 are turned open while the vacuum pump 12 is in operation for vacuum evacuation of the aerosol-generating container 2 and the deposition chamber 3 to a sufficiently low pressure. When the pressure in the aerosol-generating container 2 is sufficiently reduced, the first valve 10 is turned closed. It should be noted that the deposition chamber 3 is vacuum-evacuated during deposition.

Next, a carrier gas is introduced into the aerosol-generating container 2 by the gas-supplying system 5. The third valve 15 is turned open, and the carrier gas is blown out through the gas-blowout unit 17 into the aerosol-generating container 2. The pressure in the aerosol-generating container 2 is increased by the carrier gas introduced into the aerosol-generating container 2. Moreover, the aerosol raw material P is agitated by the carrier gas blown out from the gas-blowout unit 17, as shown in FIG. 2, and floats in the aerosol-generating container 2, forming an aerosol containing the aerosol raw material P dispersed in the carrier gas (represented by A in FIG. 2). The generated aerosol flows into the transfer tubing 6 by the pressure difference between the aerosol-generating container 2 and the deposition chamber 3 and is ejected from the nozzle 18. It is possible to control the pressure difference between the aerosol-generating container 2 and the deposition chamber 3 and the generation state of aerosol by adjustment of the opening of the third valve 15.

The aerosol (represented by A' in FIG. 2) ejected from the nozzle 18 is ejected at a flow rate specified by pressure difference between the aerosol-generating container 2 and the deposition chamber 3 and the diameter of the opening of the nozzle 18. This aerosol reaches the surface of the substrate S or a ready-made film, and the aerosol raw material P contained in the aerosol, i.e., fine particle, collides with the surface of the substrate S or the ready-made film.

By moving the substrate S, a $LiCoO_2$ thin film (represented by F in FIG. 2) is formed in a predetermined range on the substrate S. Movement of the stage 7 by the stage-driving mechanism 8 changes the relative position of the substrate S to the nozzle 18. It is possible, by moving the stage 7 in one direction in parallel with the deposition surface of the substrate S, to form a linear thin film having the same width as the diameter of the opening of nozzle 18. It is possible to further form a film on a ready-made film by reciprocating the stage 7 and thus to form a $LiCoO_2$ thin film having a predetermined film thickness. In addition, two-dimensional movement of the stage 7 gives a thin film formed in a predetermined region. The angle of the nozzle 18 to the deposition face of the substrate S may be vertical or inclined. By placing the nozzle 18 obliquely to the deposition surface, even if the aggregates of fine particles that reduce the deposition quality deposit, it is possible to remove the deposition.

In the deposition method according to this embodiment, by making the fine particles constituting the aerosol raw material P collide with each other or by making the fine particles collide with the inner surfaces of the transfer tubing 6 and the nozzle 18, static electricity is generated on the surfaces of the fine particles and the charged fine particles are deposited on the substrate S during generation of an aerosol A and during conveyance of the aerosol A by the transfer tubing 6. As the electric charge amount of the fine particles becomes large, the density of the film is increased and the deposition rate is improved. The excess charges of the deposited fine particles are released into space in the deposition chamber, which causes significant light emission depending on the amount of the released charges. Accordingly, it is possible to form a film easily even with fine particles having a relatively large particle diameter.

The charging operation of the fine particles in the process of generating an aerosol can be controlled by a flow rate of the carrier gas introduced into the aerosol-generating container 2. The fine particles are converted into an aerosol by agitation with the carrier gas. At this time, as a flow rate of the career gas is large, the collision frequency in the container inner wall or of the fine particles is increased and the electric charge amount due to friction is increased. In this embodiment, by setting a flow rate of the carrier gas to 3 SLM (standard liters per minute) or more, the charging probability of the fine particles is increased, and stable deposition is achieved.

Example 1

A $LiCoO_2$ powder whose surface was at least partially coated with an Nb film having a thickness of 38 nm, which had a mean particle diameter of 10 μm, was prepared as an aerosol raw material.

The Nb-coated $LiCoO_2$ powder was prepared by using a fine particle coating apparatus "MP-01mini" manufactured by Powrex Corp. and controlling the coating thickness. The coating condition was as follows.

[Coating Condition]

Mother liquor: niobium ethoxide (manufactured by Aldrich Corp.)

Dilute solution: dehydrated ethanol (manufactured by Wako Pure Chemical Industries, Ltd. or Kanto Chemical Co., Inc., 99%)

Mother liquor:dilute solution=1:4 (weight ratio)

Spraying rate: 2 g/min

By using the Nb-coated $LiCoO_2$ powder prepared as described above, a $LiCoO_2$ film was formed on a SUS thin plate under the following conditions (Examples 1-1, 1-2, and 1-3).

Example 1-1

Twenty g of the Nb (38 nm)-coated $LiCoO_2$ powder was put in an alumina tray, and was heated for 1 hour or more at the temperature of 300° C. in the atmosphere. After that, the Nb-coated $LiCoO_2$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 3 L/min. The $LiCoO_2$ powder in the aerosol-generating container (at the pressure of about 31 kPa) was converted into an aerosol, and then was sprayed and deposited on a substrate (SUS thin plate having a thickness of 0.1 mm) provided on a stage in the deposition chamber (at the pressure of about 290 Pa) through a transfer tubing and a nozzle (opening 5 mm×0.3 mm). The substrate was moved at the rate of 1 mm/s, and 50 layers having an area of 10 mm×10 mm were laminated to form a film. The nozzle gap (distance between the nozzle and the substrate) was 10 mm, the slope of the nozzle to the substrate was 30 degrees, and the deposition time period was about 17 minutes.

As a result, a brown-black $LiCoO_2$ film having a film thickness of 5 μm and an area of 10 mm×10 mm was formed. A film whose film quality was dense, which had strong adhesive force to the substrate, (film that is not removed even if it is scratched by a sharp metal needle) was obtained. Moreover, red violet discharge was observed during the deposition.

Example 1-2

Twenty g of the Nb (38 nm)-coated $LiCoO_2$ powder was put in an alumina tray, and was heated for 1 hour or more at the temperature of 300° C. in the atmosphere. After that, the Nb-coated $LiCoO_2$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 6 L/min. The $LiCoO_2$ powder in the aerosol-generating container (at the pressure of about 51 kPa) was converted into an aerosol, and then was sprayed and deposited on a substrate (SUS thin plate having a thickness of 0.1 mm) provided on a stage in the deposition chamber (at the pressure of about 410 Pa) through a transfer tubing and a nozzle (opening 5 mm×0.3 mm). The substrate was moved at the rate of 1 mm/s, and 50 layers having an area of 10 mm×10 mm were laminated to form a film. The nozzle gap (distance between the nozzle and the substrate) was 10 mm, the slope of the nozzle to the substrate was 30 degrees, and the deposition time period was about 17 minutes.

As a result, a brown-black $LiCoO_2$ film having a film thickness of 13 μm and an area of 10 mm×10 mm was formed. A film whose film quality was dense, which had strong adhesive force to the substrate, (film that is not removed even if it is scratched by a sharp metal needle) was obtained. Moreover, red violet discharge was observed during the deposition.

Example 1-3

Twenty g of the Nb (38 nm)-coated $LiCoO_2$ powder was put in an alumina tray, and was heated for 1 hour or more at the temperature of 300° C. in the atmosphere. After that, the Nb-coated $LiCoO_2$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 9 L/min. The $LiCoO_2$ powder in the aerosol-generating container (at the pressure of about 70 kPa) was converted into an aerosol, and then was sprayed and deposited on a substrate (SUS thin plate having a thickness of 0.1 mm) provided on a stage in the deposition chamber (at the pressure of about 530 Pa) through a transfer tubing and a nozzle (opening 5 mm×0.3 mm). The substrate was moved at the rate of 1 mm/s, and 50 layers having an area of 10 mm×10 mm were laminated to form a film. The nozzle gap (distance between the nozzle and the substrate) was 10 mm, the slope of the nozzle to the substrate was 30 degrees, and the deposition time period was about 17 minutes.

As a result, a brown-black $LiCoO_2$ film having a film thickness of 16 μm and an area of 10 mm×10 mm was formed. It was confirmed that the film thickness was increased in proportion to the agitation flow rate. A film whose film quality was dense, which had strong adhesive force to the substrate, (film that is not removed even if it is scratched by a sharp metal needle) was obtained. Moreover, red violet discharge was observed during the deposition.

Example 2

A $LiCoO_2$ powder whose surface was at least partially coated with an Nb film having a thickness of 79 nm, which had a mean particle diameter of 10 μm, was prepared as an aerosol raw material.

The Nb-coated $LiCoO_2$ powder was prepared by using a fine particle coating apparatus "MP-01mini" manufactured by Powrex Corp. and controlling the coating thickness. The coating condition was as follows.

[Coating Condition]

Mother liquor: niobium ethoxide (manufactured by Aldrich Corp.)

Dilute solution: dehydrated ethanol (manufactured by Wako Pure Chemical Industries, Ltd. or Kanto Chemical Co., Inc., 99%)

Mother liquor:dilute solution=1:4 (weight ratio)

Spraying rate: 2 g/min

By using the Nb-coated $LiCoO_2$ powder prepared as described above, a $LiCoO_2$ film was formed on a SUS thin plate under the following conditions (Examples 2-1, 2-2, and 2-3).

Example 2-1

Twenty g of the Nb (79 nm)-coated $LiCoO_2$ powder was put in an alumina tray, and was heated for 1 hour or more at the temperature of 300° C. in the atmosphere. After that, the Nb-coated $LiCoO_2$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 3 L/min. The $LiCoO_2$ powder in the aerosol-generating container (at the pressure of about 31 kPa) was converted into an aerosol, and then was sprayed and deposited on a substrate (SUS thin plate having a thickness of 0.1 mm) provided on a stage in the deposition chamber (at the pressure of about 290 Pa) through a transfer tubing and a nozzle (opening 5 mm×0.3 mm). The substrate was moved at the rate of 1 mm/s, and 50 layers having an area of 10 mm×10 mm were laminated to form a film. The nozzle gap (distance between the nozzle and the substrate) was 10 mm, the slope of the nozzle to the substrate was 30 degrees, and the deposition time period was about 17 minutes.

As a result, a brown-black $LiCoO_2$ film having a film thickness of 11 μm and an area of 10 mm×10 mm was formed. A film whose film quality was dense, which had strong adhesive force to the substrate, (film that is not removed even if it is scratched by a sharp metal needle) was obtained. Moreover, red violet discharge was observed during the deposition.

Example 2-2

Twenty g of the Nb (79 nm)-coated $LiCoO_2$ powder was put in an alumina tray, and was heated for 1 hour or more at the temperature of 300° C. in the atmosphere. After that, the Nb-coated $LiCoO_2$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 6 L/min. The $LiCoO_2$ powder in the aerosol-generating container (at the pressure of about 53 kPa) was converted into an aerosol, and then was sprayed and deposited on a substrate (SUS thin plate having a thickness of 0.1 mm) provided on a stage in the deposition chamber (at the pressure of about 400 Pa) through a transfer tubing and a nozzle (opening 5 mm×0.3 mm). The substrate was moved at the rate of 1 mm/s, and 50 layers having an area of 10 mm×10 mm were laminated to form a film. The nozzle gap (distance between the nozzle and the substrate) was 10 mm, the slope of the nozzle to the substrate was 30 degrees, and the deposition time period was about 17 minutes.

As a result, a brown-black $LiCoO_2$ film having a film thickness of 28 μm and an area of 10 mm×10 mm was formed. A film whose film quality was dense, which had strong adhesive force to the substrate, (film that is not removed even if it is scratched by a sharp metal needle) was obtained. Moreover, red violet discharge was observed during the deposition.

Example 2-3

Twenty g of the Nb (79 nm)-coated $LiCoO_2$ powder was put in an alumina tray, and was heated for 1 hour or more at the temperature of 300° C. in the atmosphere. After that, the Nb-coated $LiCoO_2$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 9 L/min. The $LiCoO_2$ powder in the aerosol-generating container (at the pressure of about 71 kPa) was converted into an aerosol, and then was sprayed and deposited on a substrate (SUS thin plate having a thickness of 0.1 mm) provided on a stage in the deposition chamber (at the pressure of about 530 Pa) through a transfer tubing and a nozzle (opening 5 mm×0.3 mm). The substrate was moved at the rate of 1 mm/s, and 50 layers having an area of 10 mm×10 mm were laminated to form a film. The nozzle gap (distance between the nozzle and the substrate) was 10 mm, the slope of the nozzle to the substrate was 30 degrees, and the deposition time period was about 17 minutes.

As a result, a brown-black $LiCoO_2$ film having a film thickness of 35 μm and an area of 10 mm×10 mm was formed. A film whose film quality was dense, which had strong adhesive force to the substrate, (film that is not removed even if it is scratched by a sharp metal needle) was obtained. Moreover, red violet discharge was observed during the deposition.

Example 3

A $LiCoO_2$ powder whose surface was at least partially coated with an Nb film having a thickness of 38 nm, which had a mean particle diameter of 10 μm, was prepared as an aerosol raw material.

The Nb-coated $LiCoO_2$ powder was prepared by using a fine particle coating apparatus "MP-01mini" manufactured by Powrex Corp. and controlling the coating thickness. The coating condition was as follows.

[Coating Condition]

Mother liquor: niobium ethoxide (manufactured by Aldrich Corp.)

Dilute solution: dehydrated ethanol (manufactured by Wako Pure Chemical Industries, Ltd. or Kanto Chemical Co., Inc., 99%)

Mother liquor:dilute solution=1:8 (weight ratio)

Spraying rate: 2 g/min

By using the Nb-coated $LiCoO_2$ powder prepared as described above, a $LiCoO_2$ film was formed on a SUS thin plate under the following conditions.

Twenty g of the Nb (38 nm)-coated $LiCoO_2$ powder was put in an alumina tray, and was heated for 1 hour or more at the temperature of 300° C. in the atmosphere. After that, the Nb-coated $LiCoO_2$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and an argon (Ar) gas for agitation was regulated using a flowmeter and supplied at 5 L/min. The $LiCoO_2$ powder in the aerosol-generating container (at the pressure of about 46 kPa) was converted into an aerosol, and then was sprayed and deposited on a substrate (SUS thin plate having a thickness of 0.1 mm) provided on a stage in the deposition chamber (at the pressure of about 280 Pa) through a transfer tubing and a nozzle (opening 10 mm×0.23 mm). The substrate was moved at the rate of 1 mm/s, and 20 layers having an area of 10 mm×8 mm were laminated to form a film. The nozzle gap (distance between the nozzle and the substrate) was 10 mm, the slope of the nozzle to the substrate was 15 degrees, and the deposition time period was about 3 minutes.

As a result, a brown-black $LiCoO_2$ film having a film thickness of 3 μm and an area of 10 mm×8 mm was formed. A film whose film quality was dense, which had strong adhesive force to the substrate, (film that is not removed even if it is scratched by a sharp metal needle) was obtained. Moreover, bluish white discharge was observed during the deposition.

Example 4

A $LiCoO_2$ powder whose surface was at least partially coated with an Nb film having a thickness of 20 nm, which had a mean particle diameter of 10 μm, was prepared as an aerosol raw material.

The Nb-coated $LiCoO_2$ powder was prepared by using a fine particle coating apparatus "MP-01mini" manufactured by Powrex Corp. and controlling the coating thickness. The coating condition was as follows.

[Coating Condition]

Mother liquor: niobium ethoxide (manufactured by Aldrich Corp.)

Dilute solution: dehydrated ethanol (manufactured by Wako Pure Chemical Industries, Ltd. or Kanto Chemical Co., Inc., 99%)

Mother liquor:dilute solution=1:8 (weight ratio)

Spraying rate: 2 g/min

By using the Nb-coated $LiCoO_2$ powder prepared as described above, a $LiCoO_2$ film was formed on a SUS thin plate under the following conditions.

Twenty g of the Nb (20 nm)-coated $LiCoO_2$ powder was put in an alumina tray, and was heated for 1 hour or more at the temperature of 300° C. in the atmosphere. After that, the Nb-coated $LiCoO_2$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and an argon (Ar) gas for agitation was regulated using a flowmeter and supplied at 5 L/min. The $LiCoO_2$ powder in the aerosol-generating container (at the pressure of about 46 kPa) was converted into an aerosol, and then was sprayed and deposited on a substrate (SUS thin plate having a thickness of 0.1 mm) provided on a stage in the deposition chamber (at the pressure of about 280 Pa) through a transfer tubing and a nozzle (opening 10 mm×0.23 mm). The substrate was moved at the rate of 1 mm/s, and 40 layers having an area of 10 mm×8 mm were laminated to form a film. The nozzle gap (distance between the nozzle and the substrate) was 10 mm, the slope of the nozzle to the substrate was 15 degrees, and the deposition time period was about 6 minutes.

As a result, a brown-black $LiCoO_2$ film having a film thickness of 0.9 μm and an area of 10 mm×8 mm was formed. A film whose film quality was dense, which had strong adhesive force to the substrate, (film that is not removed even if it is scratched by a sharp metal needle) was obtained. Moreover, bluish white discharge was observed during the deposition.

Example 5

A $LiCoO_2$ powder whose surface was at least partially coated with an Nb film having a thickness of 10 nm, which had a mean particle diameter of 10 μm, was prepared as an aerosol raw material.

The Nb-coated $LiCoO_2$ powder was prepared by using a fine particle coating apparatus "MP-01mini" manufactured by Powrex Corp. and controlling the coating thickness. The coating condition was as follows.

[Coating Condition]

Mother liquor: niobium ethoxide (manufactured by Aldrich Corp.)

Dilute solution: dehydrated ethanol (manufactured by Wako Pure Chemical Industries, Ltd. or Kanto Chemical Co., Inc., 99%)

Mother liquor:dilute solution=1:8 (weight ratio)

Spraying rate: 2 g/min

By using the Nb-coated $LiCoO_2$ powder prepared as described above, a $LiCoO_2$ film was formed on a SUS thin plate under the following conditions.

Twenty g of the Nb (10 nm)-coated $LiCoO_2$ powder was put in an alumina tray, and was heated for 1 hour or more at the temperature of 300° C. in the atmosphere. After that, the Nb-coated $LiCoO_2$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and an argon (Ar) gas for agitation was regulated using a flowmeter and supplied at 5 L/min. The $LiCoO_2$ powder in the aerosol-generating container (at the pressure of about 46 kPa) was converted into an aerosol, and then was sprayed and deposited on a substrate (SUS thin plate having a thickness of 0.1 mm) provided on a stage in the deposition chamber (at the pressure of about 280 Pa) through a transfer tubing and a nozzle (opening 10 mm×0.23 mm). The substrate was moved at the rate of 1 mm/s, and 40 layers having an area of 10 mm×8 mm were laminated to form a film. The nozzle gap (distance between the nozzle and the substrate) was 10 mm, the slope of the nozzle to the substrate was 15 degrees, and the deposition time period was about 6 minutes.

As a result, a brown-black $LiCoO_2$ film having a film thickness of 0.3 μm and an area of 10 mm×8 mm was formed. A film whose film quality was dense, which had strong adhesive force to the substrate, (film that is not removed even if it is scratched by a sharp metal needle) was obtained. Moreover, bluish white discharge was slightly observed during the deposition.

The deposition conditions and results of Examples 1 to 5 are collectively shown in Table 1.

As shown in Examples 1 and 2, it has been confirmed that as the flow rate of the career gas for agitation introduced into the aerosol-generating container is increased, the film thickness of a $LiCoO_2$ film to be formed is increased. Moreover, as shown in Examples 1 and 2, or Examples 3 to 5, it has been confirmed that also by increasing the thickness of the Nb film to be formed on the surface of the $LiCoO_2$ powder, the film thickness of the $LiCoO_2$ film to be formed is increased.

From the above, the flow rate of the career gas for agitation and the Nb coating thickness facilitate the charging of the fine particle powder in the process of passing through the transfer tubing and the nozzle, resulting in achievement of increase in the thickness of a $LiCoO_2$ film to be formed. Moreover, it has been confirmed that if the thickness of the Nb-coating is 20 nm or more, stable deposition can be achieved.

Comparative Example 1-1

Fifty g of a $LiCoO_2$ powder to which no Nb coating was applied (having mean particle diameter of 10 μm) was put in an alumina tray, and was heated for 1 hour or more at the temperature of 300° C. in the atmosphere. After that, the $LiCoO_2$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 7 L/min. The $LiCoO_2$ powder in the aerosol-generating container (at the pressure of about 82 kPa) was converted into an aerosol, and then was sprayed and deposited on a substrate (glass slide having a thickness of 1.4 mm) provided on a stage in the deposition chamber (at the pressure of about 290 Pa) through a transfer tubing and a nozzle (opening 5 mm×0.3 mm). The substrate was moved at the rate of 4 mm/s, and 200 layers having an area of 10 mm×10 mm were laminated to form a film. The nozzle gap (distance between the nozzle and the substrate) was 12 mm, the slope of the nozzle to the substrate was 30 degrees, and the deposition time period was about 17 minutes.

TABLE 1

| Example | 1-1 | 1-2 | 1-3 | 2-1 | 2-2 | 2-3 | 3 | 4 | 5 |
|---|---|---|---|---|---|---|---|---|---|
| Used raw material powder | $LiCo0_2$ (having mean particle size of 10 μm) Nb (38 nm)-coated powder | | | $LiCo0_2$ (having mean particle size of 10 μm) Nb (79 nm)-coated powder | | | $LiCo0_2$ (having mean particle size of 10 μm) Nb38 nm | Nb20 nm | Nb10 nm |
| Film thickness (μm) | 5 | 13 | 16 | 11 | 28 | 35 | 3 | 0.9 | 0.3 |
| Lamination number (Pass) | 50 | 50 | 50 | 50 | 50 | 50 | 20 | 40 | 40 |
| Pressure in container (kPa) | 31 | 51 | 70 | 31 | 53 | 71 | 46 | 46 | 46 |
| Type of gas | $N_2$ | $N_2$ | $N_2$ | $N_2$ | $N_2$ | $N_2$ | Ar | Ar | Ar |
| Flow rate of gas for agitation (SLM) | 3 | 6 | 9 | 3 | 6 | 9 | 5 | 5 | 5 |
| Temperature for drying powder (° C.) | 300 | 300 | 300 | 300 | 300 | 300 | 300 | 300 | 300 |
| Temperature for heating container (° C.) | 150 | 150 | 150 | 150 | 150 | 150 | 150 | 150 | 150 |
| Charge amount of powder (g) | 20 | 20 | 20 | 20 | 20 | 20 | 20 | 20 | 20 |
| Nozzle gap (mm) | 10 | 10 | 10 | 10 | 10 | 10 | 10 | 10 | 10 |
| Stage moving rate (m/s) | 1 | 1 | 1 | 1 | 1 | 1 | 1 | 1 | 1 |
| Deposition range | 10 mm × 10 mm | 10 mm × 10 mm | 10 mm × 10 mm | 10 mm × 10 mm | 10 mm × 10 mm | 10 mm × 10 mm | 10 mm × 8 mm | 10 mm × 8 mm | 10 mm × 8 mm |
| Used nozzle | Width of 5 mm | Width of 5 mm | Width of 5 mm | Width of 5 mm | Width of 5 mm | Width of 5 mm | Width of 10 mm | Width of 10 mm | Width of 10 mm |
| Slope of nozzle | 30 degrees | 30 degrees | 30 degrees | 30 degrees | 30 degrees | 30 degrees | 15 degrees | 15 degrees | 15 degrees |
| Substrate | SUS thin plate | SUS thin plate | SUS thin plate | SUS thin plate | SUS thin plate | SUS thin plate | SUS thin plate | SUS thin plate | SUS thin plate |

As a result, it has been confirmed that it may be impossible to form a film on the substrate under the above-mentioned condition. Moreover, the surface of the substrate is shaved, which is considered to be caused by the collision with an aerosol. No discharge was observed during the deposition.

Comparative Example 1-2

Fifty g of a $LiCoO_2$ powder to which no Nb coating was applied (having mean particle diameter of 10 μm) was put in an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 8 L/min. The $LiCoO_2$ powder in the aerosol-generating container (at the pressure of about 98 kPa) was converted into an aerosol, and then was sprayed and deposited on a substrate (glass slide having a thickness of 1.4 mm) provided on a stage in the deposition chamber (at the pressure of about 240 Pa) through a transfer tubing and a nozzle (opening 5 mm×0.3 mm). The substrate was moved at the rate of 5 mm/s, and 900 layers having an area of 5 mm×15 mm were laminated to form a film. The nozzle gap (distance between the nozzle and the substrate) was 15 mm, the slope of the nozzle to the substrate was 30 degrees, and the deposition time period was about 45 minutes.

As a result, it has been confirmed that it may be impossible to form a film on the substrate under the above-mentioned condition. Moreover, the surface of the substrate is shaved by about 20 μm, which is considered to be caused by the collision with an aerosol. No discharge was observed during the deposition.

Comparative Example 1-3

Twenty g of a $LiCoO_2$ powder to which no Nb coating was applied (having mean particle diameter of 10 μm) was put in an alumina tray, and was heated for 1 hour or more at the temperature of 300° C. in the atmosphere. After that, the $LiCoO_2$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 7 L/min. The $LiCoO_2$ powder in the aerosol-generating container (at the pressure of about 82 kPa) was converted into an aerosol, and then was sprayed and deposited on a substrate (SUS thin plate having a thickness of 0.1 mm) provided on a stage in the deposition chamber (at the pressure of about 290 Pa) through a transfer tubing and a nozzle (opening 5 mm×0.3 mm). The substrate was moved at the rate of 1 mm/s, and 50 layers having an area of 10 mm×10 mm were laminated to form a film. The nozzle gap (distance between the nozzle and the substrate) was 10 mm, the slope of the nozzle to the substrate was 30 degrees, and the deposition time period was about 17 minutes.

As a result, it has been confirmed that it may be impossible to form a film on the substrate under the above-mentioned condition. Moreover, the surface of the substrate is shaved, which is considered to be caused by the collision with an aerosol. No discharge was observed during the deposition.

Comparative Example 2-1

Sixty g of a $LiCoO_2$ powder to which no Nb coating was applied (having mean particle diameter of 5 μm) was put in an alumina tray, and was heated for 1 hour or more at the temperature of 300° C. in the atmosphere. After that, the $LiCoO_2$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 2 L/min. The $LiCoO_2$ powder in the aerosol-generating container (at the pressure of about 24 kPa) was converted into an aerosol, and then was sprayed and deposited on a substrate (SUS thin plate having a thickness of 0.1 mm) provided on a stage in the deposition chamber (at the pressure of about 170 Pa) through a transfer tubing and a nozzle (opening 5 mm×0.3 mm). The substrate was moved at the rate of 1 mm/s, and 50 layers having an area of 10 mm×10 mm were laminated to form a film. The nozzle gap (distance between the nozzle and the substrate) was 10 mm, the slope of the nozzle to the substrate was 30 degrees, and the deposition time period was about 17 minutes.

As a result, it has been confirmed that it may be impossible to form a film on the substrate under the above-mentioned condition. Moreover, the surface of the substrate is shaved, which is considered to be caused by the collision with an aerosol. No discharge was observed during the deposition.

Comparative Example 2-2

Sixty g of a $LiCoO_2$ powder to which no Nb coating was applied (having mean particle diameter of 5 μm) was put in an alumina tray, and was heated for 1 hour or more at the temperature of 300° C. in the atmosphere. After that, the $LiCoO_2$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 3 L/min. The $LiCoO_2$ powder in the aerosol-generating container (at the pressure of about 31 kPa) was converted into an aerosol, and then was sprayed and deposited on a substrate (SUS thin plate having a thickness of 0.1 mm) provided on a stage in the deposition chamber (at the pressure of about 230 Pa) through a transfer tubing and a nozzle (opening 5 mm×0.3 mm). The substrate was moved at the rate of 1 mm/s, and 50 layers having an area of 10 mm×10 mm were laminated to form a film. The nozzle gap (distance between the nozzle and the substrate) was 10 mm, the slope of the nozzle to the substrate was 30 degrees, and the deposition time period was about 17 minutes.

As a result, it has been confirmed that it may be impossible to form a film on the substrate under the above-mentioned condition. No discharge was observed during the deposition.

Comparative Example 2-3

Sixty g of a $LiCoO_2$ powder to which no Nb coating was applied (having mean particle diameter of 5 μm) was put in an alumina tray, and was heated for 1 hour or more at the temperature of 300° C. in the atmosphere. After that, the $LiCoO_2$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 4 L/min. The $LiCoO_2$ powder in the aerosol-generating container (at the pressure of about 38 kPa) was converted into an aerosol, and then was sprayed and deposited on a substrate (SUS thin plate having a thickness of 0.1 mm) provided on a stage in the deposition chamber (at the pressure of about 270 Pa) through a transfer tubing and a nozzle (opening 5 mm×0.3 mm). The substrate was moved at the rate of 1 mm/s, and 50 layers having an area of 10 mm×10 mm were laminated to form a film. The nozzle gap (distance between the nozzle and the substrate) was 10 mm, the slope of the nozzle to the substrate was 30 degrees, and the deposition time period was about 17 minutes.

As a result, it has been confirmed that it may be impossible to form a film on the substrate under the above-mentioned condition. Moreover, the surface of the substrate is shaved, which is considered to be caused by the collision with an aerosol. No discharge was observed during the deposition.

Comparative Example 3-1

Twenty g of a pulverized powder obtained by applying a milling process, for 3 hours, to a $LiCoO_2$ powder to which no Nb coating was applied (having mean particle diameter of 5 μm) was put in an alumina tray, and was heated for 1 hour or more at the temperature of 300° C. in the atmosphere. After that, the $LiCoO_2$ pulverized powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 2 L/min. The $LiCoO_2$ pulverized powder in the aerosol-generating container (at the pressure of about 24 kPa) was converted into an aerosol, and then was sprayed and deposited on a substrate (SUS thin plate having a thickness of 0.1 mm) provided on a stage in the deposition chamber (at the pressure of about 170 Pa) through a transfer tubing and a nozzle (opening 5 mm×0.3 mm). The substrate was moved at the rate of 1 mm/s, and 50 layers having an area of 10 mm×10 mm were laminated to form a film. The nozzle gap (distance between the nozzle and the substrate) was 10 mm, the slope of the nozzle to the substrate was 30 degrees, and the deposition time period was about 17 minutes.

As a result, it has been confirmed that it may be impossible to form a film on the substrate under the above-mentioned condition. No discharge was observed during the deposition.

Comparative Example 3-2

Twenty g of a pulverized powder obtained by applying a milling process, for 3 hours, to a $LiCoO_2$ powder to which no Nb coating was applied (having mean particle diameter of 5 μm) was put in an alumina tray, and was heated for 1 hour or more at the temperature of 300° C. in the atmosphere. After that, the $LiCoO_2$ pulverized powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 3 L/min. The $LiCoO_2$ pulverized powder in the aerosol-generating container (at the pressure of about 30 kPa) was converted into an aerosol, and then was sprayed and deposited on a substrate (SUS thin plate having a thickness of 0.1 mm) provided on a stage in the deposition chamber (at the pressure of about 230 Pa) through a transfer tubing and a nozzle (opening 5 mm×0.3 mm). The substrate was moved at the rate of 1 mm/s, and 50 layers having an area of 10 mm×10 mm were laminated to form a film. The nozzle gap (distance between the nozzle and the substrate) was 10 mm, the slope of the nozzle to the substrate was 30 degrees, and the deposition time period was about 17 minutes.

As a result, it has been confirmed that it may be impossible to form a film on the substrate under the above-mentioned condition. Moreover, the surface of the substrate is shaved, which is considered to be caused by the collision with an aerosol. No discharge was observed during the deposition.

Comparative Example 3-3

Twenty g of a pulverized powder obtained by applying a milling process, for 3 hours, to a $LiCoO_2$ powder to which no Nb coating was applied (having mean particle diameter of 5 μm) was put in an alumina tray, and was heated for 1 hour or more at the temperature of 300° C. in the atmosphere. After that, the $LiCoO_2$ pulverized powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 4 L/min. The $LiCoO_2$ pulverized powder in the aerosol-generating container (at the pressure of about 38 kPa) was converted into an aerosol, and then was sprayed and deposited on a substrate (SUS thin plate having a thickness of 0.1 mm) provided on a stage in the deposition chamber (at the pressure of about 270 Pa) through a transfer tubing and a nozzle (opening 5 mm×0.3 mm). The substrate was moved at the rate of 1 mm/s, and 50 layers having an area of 10 mm×10 mm were laminated to form a film. The nozzle gap (distance between the nozzle and the substrate) was 10 mm, the slope of the nozzle to the substrate was 30 degrees, and the deposition time period was about 17 minutes.

As a result, it has been confirmed that it may be impossible to form a film on the substrate under the above-mentioned condition. Moreover, the surface of the substrate is shaved, which is considered to be caused by the collision with an aerosol. No discharge was observed during the deposition.

The deposition conditions and results in Comparative Examples are collectively shown in Table 2.

TABLE 2

| Comparative Example | 1-1 | 1-2 | 1-3 | 2-1 | 2-2 | 2-3 | 3-1 | 3-2 | 3-3 |
|---|---|---|---|---|---|---|---|---|---|
| Used raw material powder | $LiCo0_2$ (having mean particle size of 10 μm) | | | $LiCo0_2$ (having mean particle size of 5 μm) No coating | | | Following pulverized powder having mean particle size of 5 μm | | |

TABLE 2-continued

| Comparative Example | 1-1 | 1-2 | 1-3 | 2-1 | 2-2 | 2-3 | 3-1 | 3-2 | 3-3 |
|---|---|---|---|---|---|---|---|---|---|
| Film thickness (μm) | No film | No film | No film | No film | No film | No film | No film | No film | No film |
| Lamination number (Pass) | 200 | 900 | 50 | 50 | 50 | 50 | 50 | 50 | 50 |
| Pressure in container (kPa) | 82 | 98 | 82 | 24 | 31 | 38 | 24 | 30 | 38 |
| Type of gas | $N_2$ | $N_2$ | $N_2$ | $N_2$ | $N_2$ | $N_2$ | $N_2$ | $N_2$ | $N_2$ |
| Flow rate of gas for agitation (SLM) | 7 | 8 | 7 | 2 | 3 | 4 | 2 | 3 | 4 |
| Time period for Milling process (H) | — | — | — | — | — | — | 3 | 3 | 3 |
| Temperature for drying powder (° C.) | 300 | — | 300 | 300 | 300 | 300 | 300 | 300 | 300 |
| Temperature for heating container (° C.) | 150 | 150 | 150 | 150 | 150 | 150 | 150 | 150 | 150 |
| Charge amount of powder (g) | 50 | 50 | 20 | 60 | 60 | 60 | 20 | 20 | 20 |
| Nozzle gap (mm) | 12 | 15 | 10 | 10 | 10 | 10 | 10 | 10 | 10 |
| Stage moving rate (m/s) | 4 | 5 | 1 | 1 | 1 | 1 | 1 | 1 | 1 |
| Deposition range | 5 mm × 20 mm | 5 mm × 15 mm | 10 mm × 10 mm | 10 mm × 10 mm | 10 mm × 10 mm | 10 mm × 10 mm | 10 mm × 10 mm | 10 mm × 10 mm | 10 mm × 10 mm |
| Used nozzle | Width of 5 mm | Width of 5 mm | Width of 5 mm | Width of 5 mm | Width of 5 mm | Width of 5 mm | Width of 5 mm | Width of 5 mm | Width of 5 mm |
| Slope of nozzle | 30 degrees | 30 degrees | 30 degrees | 30 degrees | 30 degrees | 30 degrees | 30 degrees | 30 degrees | 30 degrees |
| Substrate | Glass slide | Glass slide | SUS thin plate | SUS thin plate | SUS thin plate | SUS thin plate | SUS thin plate | SUS thin plate | SUS thin plate |

As shown in Table 2, under the conditions in Comparative Examples, it may be impossible to form a film with a $LiCoO_2$ powder to which no Nb coating is applied. Moreover, even if the size of the $LiCoO_2$ powder is reduced, it may be impossible to form a film. The reason for these results is presumed that the fine particle powder to which no Nb coating is applied is not charged in the process of passing through the transfer tubing and the nozzle.

Example 6

An $SrTiO_3$ powder whose surface was at least partially coated with an Nb film having a thickness of 20 nm, which had a mean particle diameter of 0.8 μm, was prepared as an aerosol raw material.

The Nb-coated $SrTiO_3$ powder was prepared by using a fine particle coating apparatus "MP-01mini" manufactured by Powrex Corp. and controlling the coating thickness. The coating condition was as follows.

[Coating Condition]

Mother liquor: niobium ethoxide (manufactured by Aldrich Corp.)

Dilute solution: dehydrated ethanol (manufactured by Wako Pure Chemical Industries, Ltd. or Kanto Chemical Co., Inc., 99%)

Mother liquor:dilute solution=1:8 (weight ratio)

Spraying rate: 2 g/min

By using the Nb-coated $SrTiO_3$ powder prepared as described above, an $SrTiO_3$ film was formed on a substrate (quartz, silicon wafer) under the following conditions (Examples 6-1, 6-2, 6-3, and 6-4).

Example 6-1

Fifty g of the Nb (20 nm)-coated $SrTiO_3$ powder was put in an alumina tray, and was heated for 1 hour or more at the temperature of 500° C. in the atmosphere. After that, the Nb-coated $SrTiO_3$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 3 L/min. The Nb-coated $SrTiO_3$ powder in the aerosol-generating container (at the pressure of about 23 kPa) was converted into an aerosol, and then was sprayed and deposited on a substrate (quartz plate having a thickness of 0.5 mm) provided on a stage in the deposition chamber (at the pressure of about 320 Pa) through a transfer tubing and a nozzle (opening 30 mm×0.3 mm). The substrate was moved at the rate of 1 mm/s, and 6 layers having an area of 30 mm×50 mm were laminated to form a film. The nozzle gap (distance between the nozzle and the substrate) was 15 mm, the slope of the nozzle to the substrate was 30 degrees, and the deposition time period was about 5 minutes.

As a result, an $SrTiO_3$ film having a film thickness of 3 μm and an area of 30 mm×50 mm was formed. A film whose film quality was dense, which had strong adhesive force to the substrate, (film that is not removed even if it is scratched by a sharp metal needle) was obtained. Moreover, red violet discharge was observed during the deposition.

Example 6-2

Fifty g of the Nb (20 nm)-coated $SrTiO_3$ powder was put in an alumina tray, and was heated for 1 hour or more at the temperature of 500° C. in the atmosphere. After that, the Nb-coated $SrTiO_3$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 3 L/min. The Nb-coated $SrTiO_3$ powder in the aerosol-generating container (at the pressure of about 23 kPa) was converted into an aerosol, and then was sprayed and deposited on a substrate (silicon wafer having a thickness of 0.4 mm) provided on a stage in the deposition chamber (at the pressure of about 320 Pa) through a transfer tubing and a nozzle (opening 30 mm×0.3 mm). The substrate was moved at the rate of 1 mm/s, and 6 layers having an area of 30 mm×50 mm were laminated to form a film. The nozzle gap (distance between the nozzle and the substrate)

was 15 mm, the slope of the nozzle to the substrate was 30 degrees, and the deposition time period was about 5 minutes.

As a result, an $SrTiO_3$ film having a film thickness of 2 μm and an area of 30 mm×50 mm was formed. A film whose film quality was dense, which had strong adhesive force to the substrate, (film that is not removed even if it is scratched by a sharp metal needle) was obtained. Moreover, red violet discharge was observed during the deposition.

Example 6-3

Fifty g of the Nb (20 nm)-coated $SrTiO_3$ powder was put in an alumina tray, and was heated for 1 hour or more at the temperature of 500° C. in the atmosphere. After that, the Nb-coated $SrTiO_3$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 3 L/min. The Nb-coated $SrTiO_3$ powder in the aerosol-generating container (at the pressure of about 23 kPa) was converted into an aerosol, and then was sprayed and deposited on a substrate (silicon wafer having a thickness of 0.4 mm) provided on a stage in the deposition chamber (at the pressure of about 320 Pa) through a transfer tubing and a nozzle (opening 30 mm×0.3 mm). The substrate was moved at the rate of 1 mm/s, and 12 layers having an area of 30 mm×50 mm were laminated to form a film. The nozzle gap (distance between the nozzle and the substrate) was 15 mm, the slope of the nozzle to the substrate was 30 degrees, and the deposition time period was about 10 minutes.

As a result, an $SrTiO_3$ film having a film thickness of 4 μm and an area of 30 mm×50 mm was formed. A film whose film quality was dense, which had strong adhesive force to the substrate, (film that is not removed even if it is scratched by a sharp metal needle) was obtained. Moreover, red violet discharge was observed during the deposition.

Example 6-4

Fifty g of the Nb (20 nm)-coated $SrTiO_3$ powder was put in an alumina tray, and was heated for 1 hour or more at the temperature of 500° C. in the atmosphere. After that, the Nb-coated $SrTiO_3$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 3 L/min. The Nb-coated $SrTiO_3$ powder in the aerosol-generating container (at the pressure of about 23 kPa) was converted into an aerosol, and then was sprayed and deposited on a substrate (silicon wafer having a thickness of 0.4 mm) provided on a stage in the deposition chamber (at the pressure of about 320 Pa) through a transfer tubing and a nozzle (opening 30 mm×0.3 mm). The substrate was moved at the rate of 1 mm/s, and 20 layers having an area of 30 mm×50 mm were laminated to form a film. The nozzle gap (distance between the nozzle and the substrate) was 15 mm, the slope of the nozzle to the substrate was 30 degrees, and the deposition time period was about 17 minutes.

As a result, an $SrTiO_3$ film having a film thickness of 5 μm and an area of 30 mm×50 mm was formed. A film whose film quality was dense, which had strong adhesive force to the substrate, (film that is not removed even if it is scratched by a sharp metal needle) was obtained. Moreover, red violet discharge was observed during the deposition.

The deposition conditions and results in Examples (6-1) to (6-4) are collectively shown in Table 3.

TABLE 3

| | Example | | | |
|---|---|---|---|---|
| | 6-1 | 6-2 | 6-3 | 6-4 |
| Used raw material powder | $SrTiO_3$ (having mean particle size of 0.8 μm) Nb (20 nm)-coated powder | | | |
| Film thickness (μm) | 3 | 2 | 4 | 5 |
| Lamination number (Pass) | 6 | 6 | 12 | 20 |
| Pressure in container (kPa) | 23 | 23 | 23 | 23 |
| Type of gas | $N_2$ | $N_2$ | $N_2$ | $N_2$ |
| Flow rate of gas (SLM) for agitation | 3 | 3 | 3 | 3 |
| Temperature for (° C.) drying powder | 500 | 500 | 500 | 500 |
| Temperature for (° C.) heating container | 150 | 150 | 150 | 150 |
| Charge amount of powder (g) | 50 | 50 | 50 | 50 |
| Nozzle gap (mm) | 15 | 15 | 15 | 15 |
| Stage moving rate (m/s) | 1 | 1 | 1 | 1 |
| Deposition range | 30 mm × 50 mm | 30 mm × 50 mm | 30 mm × 50 mm | 30 mm × 50 mm |
| Used nozzle | Width of 30 mm | Width of 30 mm | Width of 30 mm | Width of 30 mm |
| Slope of nozzle | 30 degrees | 30 degrees | 30 degrees | 30 degrees |
| Substrate | Quartz | Si wafer | Si wafer | Si wafer |

As shown in Table 3, it has been confirmed that it is possible to form a film stably with the Nb-coated $SrTiO_3$ powder. Moreover, as shown in Examples (6-2) to (6-4), it has been confirmed that as the lamination number is increased, the thickness of the $SrTiO_3$ film is increased.

Comparative Example 4-1

Fifty g of an $SrTiO_3$ powder to which no Nb coating was applied (having a mean particle diameter of 0.8 μm) was put in an alumina tray, and was heated for 1 hour or more at the temperature of 500° C. in the atmosphere. After that, the $SrTiO_3$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 8 L/min. The $SrTiO_3$ powder in the aerosol-generating container (at the pressure of about 29 kPa) was converted into an aerosol, and then was sprayed and deposited on a substrate (silicon wafer having a thickness of 0.4 mm) provided on a stage in the deposition chamber (at the pressure of about 410 Pa) through a transfer tubing and a nozzle (opening 30 mm×0.3 mm). The substrate was moved at the rate of 1 mm/s, and 60 layers having an area of 30 mm×30 mm were laminated to form a film. The nozzle gap (distance between the nozzle and the substrate) was 15 mm, the slope of the nozzle to the substrate was 30 degrees, and the deposition time period was about 30 minutes.

As a result, it has been confirmed that under the above-mentioned condition, it may be impossible to form a film stably (film thickness is 0.1 μm or less). No discharge was observed during the deposition.

Comparative Example 4-2

Fifty g of an $SrTiO_3$ powder to which no Nb coating was applied (having a mean particle diameter of 0.8 μm) was put in an alumina tray, and was heated for 1 hour or more at the temperature of 500° C. in the atmosphere. After that, the $SrTiO_3$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 8 L/min. The $SrTiO_3$ powder in the aerosol-generating container (at the pressure of about 29 kPa) was converted into an aerosol, and then was sprayed and deposited on a substrate (glass slide having a thickness of 1.4 mm) provided on a stage in the deposition chamber (at the pressure of about 410 Pa) through a transfer tubing and a nozzle (opening 30 mm×0.3 mm). The substrate was moved at the rate of 1 mm/s, and 60 layers having an area of 30 mm×30 mm were laminated to form a film. The nozzle gap (distance between the nozzle and the substrate) was 15 mm, the slope of the nozzle to the substrate was 30 degrees, and the deposition time period was about 30 minutes.

As a result, it has been confirmed that under the above-mentioned condition, it may be impossible to form a film stably (film thickness is 0.1 μm or less). No discharge was observed during the deposition.

Comparative Example 4-3

Fifty g of an $SrTiO_3$ powder to which no Nb coating was applied (having a mean particle diameter of 0.8 μm) was put in an alumina tray, and was heated for 1 hour or more at the temperature of 500° C. in the atmosphere. After that, the $SrTiO_3$ powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 7 L/min. The $SrTiO_3$ powder in the aerosol-generating container (at the pressure of about 27 kPa) was converted into an aerosol, and then was sprayed and deposited on a substrate (glass slide having a thickness of 1.4 mm) provided on a stage in the deposition chamber (at the pressure of about 360 Pa) through a transfer tubing and a nozzle (opening 30 mm×0.3 mm). The substrate was moved at the rate of 1 mm/s, and 600 layers having an area of 30 mm×30 mm were laminated to form a film. The nozzle gap (distance between the nozzle and the substrate) was 15 mm, the slope of the nozzle to the substrate was 30 degrees, and the deposition time period was about 300 minutes.

As a result, it has been confirmed that under the above-mentioned condition, it may be impossible to form a film stably (film thickness is 0.1 μm or less). No discharge was observed during the deposition.

Comparative Example 5-1

Fifty g of a pulverized powder obtained by applying a milling process, for 3 hours, to an $SrTiO_3$ powder to which no Nb coating was applied (having mean particle diameter of 0.8 μm) was put in an alumina tray, and was heated for 1 hour or more at the temperature of 500° C. in the atmosphere. After that, the $SrTiO_3$ pulverized powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 8 L/min. The $SrTiO_3$ pulverized powder in the aerosol-generating container (at the pressure of about 29 kPa) was converted into an aerosol, and then was sprayed and deposited on a substrate (silicon wafer having a thickness of 0.4 mm) provided on a stage in the deposition chamber (at the pressure of about 410 Pa) through a transfer tubing and a nozzle (opening 30 mm×0.3 mm). The substrate was moved at the rate of 1 mm/s, and 60 layers having an area of 30 mm×30 mm were laminated to form a film. The nozzle gap (distance between the nozzle and the substrate) was 15 mm, the slope of the nozzle to the substrate was 30 degrees, and the deposition time period was about 30 minutes.

As a result, it has been confirmed that it may be impossible to form a film stably under the above-mentioned condition (film thickness is 0.1 μm). No discharge was observed during the deposition.

Comparative Example 5-2

Fifty g of a pulverized powder obtained by applying a milling process, for 3 hours, to an $SrTiO_3$ powder to which no Nb coating was applied (having mean particle diameter of 0.8 μm) was put in an alumina tray, and was heated for 1 hour or more at the temperature of 500° C. in the atmosphere. After that, the $SrTiO_3$ pulverized powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 8 L/min. The $SrTiO_3$ pulverized powder in the aerosol-generating container (at the pressure of about 29 kPa) was converted into an aerosol, and then was sprayed and deposited on a substrate (glass slide having a thickness of 1.4 mm) provided on a stage in the deposition chamber (at the pressure of about 410 Pa) through a transfer tubing and a nozzle (opening 30 mm×0.3 mm). The substrate was moved at the rate of 1 mm/s, and 180 layers having an area of 30 mm×30 mm were laminated to form a film. The nozzle gap (distance between the nozzle and the substrate) was 15 mm, the slope of the nozzle to the substrate was 30 degrees, and the deposition time period was about 90 minutes.

As a result, it has been confirmed that it may be impossible to form a film stably under the above-mentioned condition (film thickness is 0.1 μm). No discharge was observed during the deposition.

Comparative Example 6-1

Fifty g of a pulverized powder obtained by applying a milling process, for 3 hours, to a Nb (20 nm)-coated $SrTiO_3$ powder (having mean particle diameter of 0.8 μm) was put in an alumina tray, and was heated for 1 hour or more at the temperature of 500° C. in the atmosphere. After that, the pulverized powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 5 L/min. The $SrTiO_3$ pulverized powder in the aerosol-generating container (at the pressure of about 22 kPa) was converted into an aerosol, and then was sprayed and deposited on a substrate (silicon wafer having a thickness of 0.4 mm) provided on a stage in the deposition chamber (at the pressure of about 320 Pa) through a transfer tubing and a nozzle (opening 30 mm×0.3 mm). The substrate was moved at the rate of 1 mm/s, and 10 layers having an area of 30 mm×50 mm were laminated to form a film. The nozzle gap (distance between the nozzle and the substrate) was 15 mm, the slope of the nozzle to the substrate was 30 degrees, and the deposition time period was about 9 minutes.

As a result, although an $SrTiO_3$ film having a film thickness of 6 μm is formed, the adhesive force to the substrate is weak and the film is liable to be removed from the substrate. No discharge was observed during the deposition.

Comparative Example 6-2

Fifty g of a pulverized powder obtained by applying a milling process, for 3 hours, to a Nb (20 nm)-coated $SrTiO_3$ powder (having mean particle diameter of 0.8 μm) was put in an alumina tray, and was heated for 1 hour or more at the temperature of 500° C. in the atmosphere. After that, the pulverized powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 7 L/min. The $SrTiO_3$ pulverized powder in the aerosol-generating container (at the pressure of about 27 kPa) was converted into an aerosol, and then was sprayed and deposited on a substrate (silicon wafer having a thickness of 0.4 mm) provided on a stage in the deposition chamber (at the pressure of about 360 Pa) through a transfer tubing and a nozzle (opening 30 mm×0.3 mm). The substrate was moved at the rate of 1 mm/s, and 4 layers having an area of 30 mm×50 mm were laminated to form a film. The nozzle gap (distance between the nozzle and the substrate) was 15 mm, the slope of the nozzle to the substrate was 30 degrees, and the deposition time period was about 4 minutes.

As a result, it has been confirmed that under the above-mentioned condition, it may be impossible to form a film stably (film thickness if 0.1 μm or less). Moreover, the density of the film is low and the film was a green compact. No discharge was observed during the deposition.

The deposition conditions and results in Comparative Examples are collectively shown in Table 4.

TABLE 4

| Comparative Example | 4-1 | 4-2 | 4-3 | 5-1 | 5-2 | 6-1 | 6-2 |
|---|---|---|---|---|---|---|---|
| Used raw material powder | $SrTi0_3$ (having mean particle size of 0.8 μm) | | | Following pulverized powder having mean particle size of 0.8 μm | | $SrTi0_3$ (having mean particle size of 0.8 μm) | |
| | | | No coating | | | Nb (20 nm)-coated pulverized powder | |
| Film thickness (μm) | <0.1 | <0.1 | <0.1 | <0.1 | <0.1 | 6 (Many films are removed) | <0.1 |
| Lamination number (Pass) | 60 | 60 | 600 | 60 | 180 | 10 | 4 |
| Pressure in container (kPa) | 29 | 29 | 27 | 29 | 29 | 22 | 27 |
| Type of gas | $N_2$ | $N_2$ | $N_2$ | $N_2$ | $N_2$ | $N_2$ | $N_2$ |
| Flow rate of gas for agitation (SLM) | 8 | 8 | 7 | 8 | 8 | 5 | 7 |
| Time period for Milling process (H) | — | — | — | 3 hours | 3 hours | 3 hours | 3 hours |
| Temperature for drying powder (° C.) | 500 | 500 | 500 | 500 | 500 | 500 | 500 |
| Temperature for heating container (° C.) | 150 | 150 | 150 | 150 | 150 | 150 | 150 |
| Charge amount of powder (g) | 50 | 50 | 50 | 50 | 50 | 50 | 50 |
| Nozzle gap (mm) | 15 | 15 | 15 | 15 | 15 | 15 | 15 |
| Stage moving rate (m/s) | 1 | 1 | 5 | 1 | 1 | 1 | 1 |
| Deposition range | 30 mm × 30 mm | 30 mm × 30 mm | 30 mm × 30 mm | 30 mm × 30 mm | 30 mm × 30 mm | 30 mm × 30 mm | 30 mm × 30 mm |
| Used nozzle | Width of 30 mm | Width of 30 mm | Width of 30 mm | Width of 30 mm | Width of 30 mm | Width of 30 mm | Width of 30 mm |
| Slope of nozzle | 30 degrees | 30 degrees | 30 degrees | 30 degrees | 30 degrees | 30 degrees | 30 degrees |
| Substrate | Si wafer | Glass slide | Glass slide | Si wafer | Glass slide | Si wafer | Si wafer |

As shown in Table 4, under the conditions in Comparative Examples, it may be impossible to form a film stably with an $SrTiO_3$ powder to which no Nb coating is applied. Moreover, even if the size of the Nb-coated $SrTiO_3$ powder is reduced, a dense film having high adhesive force is not obtained. The reason for these results is presumed that the fine particle powder to which (almost) no Nb coating is applied is not charged in the process of passing through the transfer tubing and the nozzle.

Example 7

A ZnO powder whose surface was at least partially coated with a Ba film having a thickness of 30 nm, which had a mean particle diameter of 11.7 μm, was prepared as an aerosol raw material.

The Ba-coated ZnO powder was prepared by using a fine particle coating apparatus "MP-01mini" manufactured by Powrex Corp. and controlling the coating thickness. The coating condition was as follows.

[Coating Condition]

Mother liquor: Barium Isopropoxide (manufactured by Aldrich Corp.)

Dilute solution: dehydrated ethanol (manufactured by Wako Pure Chemical Industries, Ltd. or Kanto Chemical Co., Inc., 99%)

Mother liquor:dilute solution=1:8 (weight ratio)

Spraying rate: 2 g/min

By using the Ba-coated ZnO powder prepared as described above, a ZnO film was formed on a silicon wafer under the following conditions (Examples 7-1, 7-2, and 7-3).

Example 7-1

Fifty g of the Ba (30 nm)-coated ZnO powder was put in an alumina tray, and was heated for 1 hour or more at the temperature of 350° C. in the atmosphere. After that, the Ba-coated ZnO powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 5 L/min. The Ba-coated ZnO powder in the aerosol-generating container (at the pressure of about 22 kPa) was converted into an aerosol, and then was sprayed and deposited on a substrate (silicon wafer having a thickness of 0.4 mm) provided on a stage in the deposition chamber (at the pressure of about 320 Pa) through a transfer tubing and a nozzle (opening 30 mm×0.3 mm). The substrate was moved at the rate of 1 mm/s, and 50 layers having an area of 30 mm×20 mm were laminated to form a film. The nozzle gap (distance between the nozzle and the substrate) was 10 mm, the slope of the nozzle to the substrate was 30 degrees, and the deposition time period was about 17 minutes.

As a result, a ZnO film having a film thickness of 2 μm and an area of 30 mm×20 mm was formed. A film whose film quality was dense, which had strong adhesive force to the substrate, (film that is not removed even if it is scratched by a sharp metal needle) was obtained. Moreover, red violet discharge was observed during the deposition.

Example 7-2

Fifty g of the Ba (30 nm)-coated ZnO powder was put in an alumina tray, and was heated for 1 hour or more at the temperature of 350° C. in the atmosphere. After that, the Ba-coated ZnO powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 7 L/min. The Ba-coated ZnO powder in the aerosol-generating container (at the pressure of about 27 kPa) was converted into an aerosol, and then was sprayed and deposited on a substrate (silicon wafer having a thickness of 0.4 mm) provided on a stage in the deposition chamber (at the pressure of about 360 Pa) through a transfer tubing and a nozzle (opening 30 mm×0.3 mm). The substrate was moved at the rate of 1 mm/s, and 50 layers having an area of 30 mm×20 mm were laminated to form a film. The nozzle gap (distance between the nozzle and the substrate) was 10 mm, the slope of the nozzle to the substrate was 30 degrees, and the deposition time period was about 17 minutes.

As a result, a ZnO film having a film thickness of 2.5 μm and an area of 30 mm×20 mm was formed. A film whose film quality was dense, which had strong adhesive force to the substrate, (film that is not removed even if it is scratched by a sharp metal needle) was obtained. Moreover, red violet discharge was observed during the deposition.

Example 7-3

Fifty g of the Ba (30 nm)-coated ZnO powder was put in an alumina tray, and was heated for 1 hour or more at the temperature of 350° C. in the atmosphere. After that, the Ba-coated ZnO powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 8 L/min. The Ba-coated ZnO powder in the aerosol-generating container (at the pressure of about 29 kPa) was converted into an aerosol, and then was sprayed and deposited on a substrate (silicon wafer having a thickness of 0.4 mm) provided on a stage in the deposition chamber (at the pressure of about 360 Pa) through a transfer tubing and a nozzle (opening 30 mm×0.3 mm). The substrate was moved at the rate of 1 mm/s, and 50 layers having an area of 30 mm×20 mm were laminated to form a film. The nozzle gap (distance between the nozzle and the substrate) was 10 mm, the slope of the nozzle to the substrate was 30 degrees, and the deposition time period was about 17 minutes.

As a result, a ZnO film having a film thickness of 3 μm and an area of 30 mm×20 mm was formed. A film whose film quality was dense, which had strong adhesive force to the substrate, (film that is not removed even if it is scratched by a sharp metal needle) was obtained. Moreover, red violet discharge was observed during the deposition.

The deposition conditions and results in Examples (7-1) to (7-3) are collectively shown in Table 5.

TABLE 5

| | Example | | |
|---|---|---|---|
| | 7-1 | 7-2 | 7-3 |
| Used raw material powder | ZnO (having mean particle size of 11.7 μm) Ba (30 nm)-coated powder | | |
| Film thickness (μm) | 2 | 2.5 | 3 |
| Lamination number (Pass) | 50 | 50 | 50 |
| Pressure in container (kPa) | 22 | 27 | 29 |
| Type of gas | $N_2$ | $N_2$ | $N_2$ |
| Flow rate of gas (SLM) for agitation | 5 | 7 | 8 |
| Temperature for (° C.) drying powder | 350 | 350 | 350 |
| Temperature for (° C.) heating container | 150 | 150 | 150 |
| Charge amount of powder (g) | 50 | 50 | 50 |
| Nozzle gap (mm) | 10 | 10 | 10 |
| Stage moving rate (m/s) | 1 | 1 | 1 |

TABLE 5-continued

| | Example | | |
|---|---|---|---|
| | 7-1 | 7-2 | 7-3 |
| Deposition range | 30 mm × 20 mm | 30 mm × 20 mm | 30 mm × 20 mm |
| Used nozzle | Width of 30 mm | Width of 30 mm | Width of 30 mm |
| Slope of nozzle | 30 degrees | 30 degrees | 30 degrees |
| Substrate | Si wafer | Si wafer | Si wafer |

As shown in Table 5, it has been confirmed that it is possible to form a ZnO film stably with the Ba-coated ZnO powder. Moreover, as shown in Examples (7-1) to (7-3), as the flow rate of the career gas for agitation is increased, the thickness of the ZnO film is increased.

Comparative Example 7

Fifty g of a ZnO powder to which no Ba coating is applied (having mean particle diameter of 0.6 μm) was put in an alumina tray, and was heated for 1 hour or more at the temperature of 350° C. in the atmosphere. After that, the ZnO powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 8 L/min. The ZnO powder in the aerosol-generating container (at the pressure of about 40 kPa) was converted into an aerosol, and then was sprayed and deposited on a substrate (silicon wafer having a thickness of 0.4 mm) provided on a stage in the deposition chamber (at the pressure of about 360 Pa) through a transfer tubing and a nozzle (opening 30 mm×0.3 mm). The substrate was moved at the rate of 5 mm/s, and 300 layers having an area of 30 mm×8 mm were laminated to form a film. The nozzle gap (distance between the nozzle and the substrate) was 12 mm, the slope of the nozzle to the substrate was 30 degrees, and the deposition time period was about 8 minutes.

As a result, it has been confirmed that it may be impossible to form a film and the substrate is shaved under the above-mentioned condition. No discharge was observed during the deposition.

Comparative Example 8-1

Fifty g of a processed powder obtained by applying a milling process, for 3 hours, to a ZnO powder to which no Ba coating is applied (having mean particle diameter of 0.6 μm) was put in an alumina tray, and was heated for 1 hour or more at the temperature of 350° C. in the atmosphere. After that, the ZnO powder was quickly transferred to an aerosol-generating container made of glass and was vacuum-evacuated to 10 Pa or less.

The exhaust valve of the aerosol-generating container was closed, and a nitrogen ($N_2$) gas for agitation was regulated using a flowmeter and supplied at 3 L/min. The ZnO powder in the aerosol-generating container (at the pressure of about 16 kPa) was converted into an aerosol, and then was sprayed and deposited on a substrate (silicon wafer having a thickness of 0.4 mm) provided on a stage in the deposition chamber (at the pressure of about 170 Pa) through a transfer tubing and a nozzle (opening 30 mm×0.3 mm). The substrate was moved at the rate of 5 mm/s, and 300 layers having an area of 30 mm×8 mm were laminated to form a film. The nozzle gap (distance between the nozzle and the substrate) was 12 mm, the slope of the nozzle to the substrate was 30 degrees, and the deposition time period was about 8 minutes.

As a result, it has been confirmed that under the above-mentioned condition, it may be impossible to form a film and the substrate is shaved (by 1 μm). No discharge was observed during the deposition.

Comparative Example 8-2

Fifty g of a processed powder obtained by applying a milling process, for 3 hours, to a ZnO powder to which no Ba coating is applied (having mean particle diameter of 0.6 μm) was put in an alumina tray, and was heated for 1 hour or more at the temperature of 350° C. in the atmosphere. After that, the ZnO powder was quickly transferred to an aerosol-generating container made of glass and was vacuum-evacuated to 10 Pa or less.

The exhaust valve of the aerosol-generating container was closed, and a nitrogen ($N_2$) gas for agitation was regulated using a flowmeter and supplied at 2.5 L/min. The ZnO powder in the aerosol-generating container (at the pressure of about 72 kPa) was converted into an aerosol, and then was sprayed and deposited on a substrate (silicon wafer having a thickness of 0.4 mm) provided on a stage in the deposition chamber (at the pressure of about 930 Pa) through a transfer tubing and a nozzle (opening 30 mm×0.3 mm). The substrate was moved at the rate of 5 mm/s, and 1200 layers having an area of 30 mm×8 mm were laminated to form a film. The nozzle gap (distance between the nozzle and the substrate) was 12 mm, the slope of the nozzle to the substrate was 30 degrees, and the deposition time period was about 32 minutes.

As a result, it has been confirmed that under the above-mentioned condition, it may be impossible to form a film (film thickness is 0.1 μm less). No discharge was observed during the deposition.

Comparative Example 8-3

Fifty g of a pulverized powder obtained by applying a milling process, for 5 hours, to a ZnO powder to which no Ba coating is applied (having mean particle diameter of 0.6 μm) was put in an alumina tray, and was heated for 1 hour or more at the temperature of 350° C. in the atmosphere. After that, the ZnO pulverized powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 7 L/min. The ZnO pulverized powder in the aerosol-generating container (at the pressure of about 27 kPa) was converted into an aerosol, and then was sprayed and deposited on a substrate (glass slide having a thickness of 1.4 mm) provided on a stage in the deposition chamber (at the pressure of about 370 Pa) through a transfer tubing and a nozzle (opening 30 mm×0.3 mm). The substrate was moved at the rate of 1 mm/s, and 300 layers having an area of 30 mm×20 mm were laminated to form a film. The nozzle gap (distance between the nozzle and the substrate) was 16 mm, the slope of the nozzle to the substrate was 30 degrees, and the deposition time period was about 100 minutes.

As a result, it has been confirmed that under the above-mentioned condition, it may be impossible to form a film (film thickness is 0.1 μm less). No discharge was observed during the deposition.

Comparative Example 8-4

Fifty g of a pulverized powder obtained by applying a milling process, for 10 hours, to a ZnO powder to which no Ba coating is applied (having mean particle diameter of 0.6 μm) was put in an alumina tray, and was heated for 1 hour or more at the temperature of 350° C. in the atmosphere. After that, the ZnO pulverized powder was quickly transferred to an aerosol-generating container made of glass and was vacuum-evacuated to 10 Pa or less.

The exhaust valve of the aerosol-generating container was closed, and a nitrogen ($N_2$) gas for agitation was regulated using a flowmeter and supplied at 7 L/min. The ZnO pulverized powder in the aerosol-generating container (at the pressure of about 27 kPa) was converted into an aerosol, and then was sprayed and deposited on a substrate (silicon wafer having a thickness of 0.4 mm) provided on a stage in the deposition chamber (at the pressure of about 360 Pa) through a transfer tubing and a nozzle (opening 30 mm×0.3 mm). The substrate was moved at the rate of 5 mm/s, and 1200 layers having an area of 30 mm×30 mm were laminated to form a film. The nozzle gap (distance between the nozzle and the substrate) was 12 mm, the slope of the nozzle to the substrate was 30 degrees, and the deposition time period was about 120 minutes.

As a result, it has been confirmed that under the above-mentioned condition, it may be impossible to form a film (film thickness is 0.1 μm less). No discharge was observed during the deposition.

Comparative Example 9

Fifty g of a ZnO powder to which no Ba coating is applied (having mean particle diameter of 2.2 μm) was put in an alumina tray, and was heated for 1 hour or more at the temperature of 350° C. in the atmosphere. After that, the ZnO powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 7 L/min. The ZnO powder in the aerosol-generating container (at the pressure of about 27 kPa) was converted into an aerosol, and then was sprayed and deposited on a substrate (silicon wafer having a thickness of 0.4 mm) provided on a stage in the deposition chamber (at the pressure of about 360 Pa) through a transfer tubing and a nozzle (opening 30 mm×0.3 mm). The substrate was moved at the rate of 1 mm/s, and 50 layers having an area of 30 mm×20 mm were laminated to form a film. The nozzle gap (distance between the nozzle and the substrate) was 10 mm, the slope of the nozzle to the substrate was 30 degrees, and the deposition time period was about 17 minutes.

As a result, it has been confirmed that under the above-mentioned condition, it may be impossible to form a film (film thickness is 0.1 μm less). No discharge was observed during the deposition.

Comparative Example 10

Fifty g of a ZnO powder to which no Ba coating is applied (having mean particle diameter of 5.9 μm) was put in an alumina tray, and was heated for 1 hour or more at the temperature of 350° C. in the atmosphere. After that, the ZnO powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 7 L/min. The ZnO powder in the aerosol-generating container (at the pressure of about 27 kPa) was converted into an aerosol, and then was sprayed and deposited on a substrate (silicon wafer having a thickness of 0.4 mm) provided on a stage in the deposition chamber (at the pressure of about 360 Pa) through a transfer tubing and a nozzle (opening 30 mm×0.3 mm). The substrate was moved at the rate of 1 mm/s, and 50 layers having an area of 30 mm×20 mm were laminated to form a film. The nozzle gap (distance between the nozzle and the substrate) was 10 mm, the slope of the nozzle to the substrate was 30 degrees, and the deposition time period was about 17 minutes.

As a result, it has been confirmed that under the above-mentioned condition, it may be impossible to form a film (film thickness is 0.1 μm less). No discharge was observed during the deposition.

Comparative Example 11

Fifty g of a ZnO powder to which no Ba coating is applied (having mean particle diameter of 11.7 μm) was put in an alumina tray, and was heated for 1 hour or more at the temperature of 350° C. in the atmosphere. After that, the ZnO powder was quickly transferred to an aerosol-generating container made of glass and was vacuum-evacuated to 10 Pa or less. In order to facilitate the degassing of the powder, the aerosol-generating container was heated at the temperature of 150° C. by a mantle heater.

The exhaust valve of the aerosol-generating container was closed, and a nitrogen ($N_2$) gas for agitation was regulated using a flowmeter and supplied at 7 L/min. The ZnO powder in the aerosol-generating container (at the pressure of about 27 kPa) was converted into an aerosol, and then was sprayed and deposited on a substrate (silicon wafer having a thickness of 0.4 mm) provided on a stage in the deposition chamber (at the pressure of about 360 Pa) through a transfer tubing and a nozzle (opening 30 mm×0.3 mm). The substrate was moved at the rate of 1 mm/s, and 50 layers having an area of 30 mm×20 mm were laminated to form a film. The nozzle gap (distance between the nozzle and the substrate) was 10 mm, the slope of the nozzle to the substrate was 30 degrees, and the deposition time period was about 17 minutes.

As a result, it has been confirmed that under the above-mentioned condition, it may be impossible to form a film (film thickness is 0.1 μm less). No discharge was observed during the deposition.

The deposition conditions and results in Comparative Examples are collectively shown in Table 6.

TABLE 6

| Comparative Example | 7 | 8-1 | 8-2 | 8-3 | 8-4 | 9 | 10 | 11 |
|---|---|---|---|---|---|---|---|---|
| Used raw material powder | Zn0 (0.6 μm) | Following pulverized powder having mean particle size of 0.6 μm | | | | Zn0 (2.2 μm) | Zn0 (5.9 μm) | Zn0 (11.7 μm) |
| | | | | No coating | | | | |
| Film thickness (μm) | No film | No film | <0.1 | <0.1 | <0.1 | <0.1 | <0.1 | <0.1 |
| Lamination number (Pass) | 300 | 300 | 1200 | 300 | 1200 | 50 | 50 | 50 |
| Pressure in container (kPa) | 40 | 16 | 72 | 27 | 27 | 27 | 27 | 27 |
| Type of gas | $N_2$ | $N_2$ | $N_2$ | $N_2$ | $N_2$ | $N_2$ | $N_2$ | $N_2$ |
| Flow rate of gas for agitation (SLM) | 8 | 3 | 2.5 | 7 | 7 | 7 | 7 | 7 |
| Time period for Milling process (H) | — | 3 | 3 | 5 | 10 | — | — | — |
| Temperature for drying powder (° C.) | 350 | 350 | 350 | 350 | 350 | 350 | 350 | 350 |
| Temperature for heating container (° C.) | 150 | — | — | 150 | — | 150 | 150 | 150 |
| Charge amount of powder (g) | 50 | 50 | 50 | 50 | 50 | 50 | 50 | 50 |
| Nozzle gap (mm) | 12 | 12 | 12 | 16 | 12 | 10 | 10 | 10 |
| Stage moving rate (m/s) | 5 | 5 | 5 | 1 | 5 | 1 | 1 | 1 |
| Deposition range | 30 mm × 8 mm | 30 mm × 8 mm | 30 mm × 8 mm | 30 mm × 20 mm | 30 mm × 30 mm | 30 mm × 20 mm | 30 mm × 20 mm | 30 mm × 20 mm |
| Used nozzle | Width of 30 mm | Width of 30 mm | Width of 30 mm | Width of 30 mm | Width of 30 mm | Width of 30 mm | Width of 30 mm | Width of 30 mm |
| Slope of nozzle | 30 degrees | 30 degrees | 30 degrees | 30 degrees | 30 degrees | 30 degrees | 30 degrees | 30 degrees |
| Substrate | Si wafer | Si wafer | Si wafer | Glass slide | Si wafer | Si wafer | Si wafer | Si wafer |

As shown in Table 6, under the conditions in Comparative Examples, it may be impossible to form a film stably with a ZnO powder to which no Ba coating is applied. The reason for these results is presumed that the fine particle powder to which (almost) no Ba coating is applied is not charged in the process of passing through the transfer tubing and the nozzle.

Although embodiments of the present disclosure have been described, the present disclosure is not limited thereto, and various modifications can be made based on the technical ideas of the present disclosure.

For example, in the above-mentioned embodiments, $LiCoO_2$, $SrTiO_3$, and ZnO powder are used as a matrix of a fine particle powder for the description. However, the matrix of a fine particle powder is not limited thereto, and $LiNiO_2$ powder or the like may be used. In this case, a film formation may be performed using, as a raw material, a powder obtained by coating metal such as NB, Ba, Ca, and Sc or an oxide thereof.

The present disclosure contains subject matter related to that disclosed in Japanese Priority Patent Application JP 2012-145311 filed in the Japan Patent Office on Jun. 28, 2012, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A deposition method, comprising:

placing particles in an airtight container, wherein the particles include a matrix and a coating layer formed on a surface of the matrix, and wherein the coating layer is configured to be more likely to be charged than the matrix when contacting a material of a conveying path;

generating an aerosol of the particles by introducing a carrier gas into the airtight container;

transporting the aerosol via a transfer tubing to a deposition chamber which is maintained at a pressure lower than that in the airtight container while charging the particles by friction with the inner surface of the transfer tubing, the transfer tubing being connected to the airtight container and having a nozzle at a tip of the transfer tubing; and depositing the charged particles on a substrate placed in the deposition chamber by spraying the aerosol from the nozzle;

wherein the conveying path includes an inner surface of the nozzle and an inner wall surface of the transfer tubing; and wherein the nozzle is disposed in the deposition chamber.

2. The deposition method according to claim 1, wherein:

the matrix includes a metal oxide, and the coating layer includes a metal material.

3. The deposition method according to claim 1, wherein:

the nozzle includes a metal material, and the coating layer includes a metal material having a work function smaller than a work function of the metal material of the nozzle.

4. The deposition method according to claim 1, wherein:

the matrix includes any one of LiCoO2, SrTiO3, and ZnO, and the coating layer includes any one of Nb, Ba, Ca, and Sc.

5. The deposition method according to claim 4, wherein:

the coating layer is formed so as to have a thickness of 10 nm or more.

* * * * *